US011621520B2

(12) United States Patent
Canol et al.

(10) Patent No.: US 11,621,520 B2
(45) Date of Patent: Apr. 4, 2023

(54) ELECTRICAL DATA CONNECTOR

(71) Applicant: Lear Corporation, Southfield, MI (US)

(72) Inventors: Yasin Canol, Remscheid (DE); Andreas Behrendt, Remscheid (DE); Marlon Christian Grosser, Remscheid (DE)

(73) Assignee: Lear Corporation, Southfield, MI (US)

( * ) Notice: Subject to any disclaimer, the term of this patent is extended or adjusted under 35 U.S.C. 154(b) by 5 days.

(21) Appl. No.: 17/541,960

(22) Filed: Dec. 3, 2021

(65) Prior Publication Data

US 2022/0190515 A1 Jun. 16, 2022

(30) Foreign Application Priority Data

Dec. 14, 2020 (DE) ..... 102020133318.8

(51) Int. Cl.
*H01R 13/627* (2006.01)
*H01R 13/6591* (2011.01)
*H01R 13/426* (2006.01)

(52) U.S. Cl.
CPC ..... *H01R 13/6273* (2013.01); *H01R 13/426* (2013.01); *H01R 13/6591* (2013.01)

(58) Field of Classification Search
CPC ..... H01R 13/6582; H01R 13/6583; H01R 13/6273; H01R 13/6591; H01R 13/426
USPC ..... 439/607.17, 607.19, 607.44
See application file for complete search history.

(56) References Cited

U.S. PATENT DOCUMENTS 6,416,358 B1 * 7/2002 Kamarauskas ..... H01R 13/506 439/607.38
6,511,348 B1 1/2003 Wojtacki et al.
7,172,467 B1 2/2007 Yohn et al.
8,834,205 B2 9/2014 Fogg et al.
9,147,981 B2 9/2015 Oh et al.
9,667,002 B1 5/2017 Martin
9,673,570 B2 6/2017 Briant et al.
(Continued)

FOREIGN PATENT DOCUMENTS

DE 102019200713 B3 7/2020
EP 3557699 A1 10/2019
(Continued)

OTHER PUBLICATIONS

German Patent and Trademark Office, Examination Report, Application No. 102020133318.8, dated Jul. 16, 2021.

*Primary Examiner* — Gary F Paumen
(74) *Attorney, Agent, or Firm* — MacMillan, Sobanski & Todd, LLC

(57) ABSTRACT

An electrical data connector includes a socket having a socket body that defines a plug connector cavity and electrically conductive shields within the cavity. A plug connector has a plug body telescopically slid into the plug connector cavity. The plug body has an insert cavity and adjacent spring openings, each of the spring openings aligning with a respective one of the shields. A cable head has an insert module telescopically slid into the insert cavity. The cable head includes an electrically conductive fixation element that is fixed to the insert module and fixed to a cable. The fixation element includes integral spring elements that extend generally radially outwardly from the insert module and are each configured to extend through respective spring openings into contact with respective shields.

18 Claims, 4 Drawing Sheets

(56) References Cited

U.S. PATENT DOCUMENTS

| | | | | |
|---|---|---|---|---|
| 10,297,956 | B2 | 5/2019 | Abouklassem et al. | |
| 10,439,333 | B2 | 10/2019 | Chalas et al. | |
| 2007/0243730 | A1* | 10/2007 | Gladd | H01R 13/65917 439/98 |
| 2008/0132116 | A1* | 6/2008 | Wu | H01R 27/00 439/607.17 |
| 2012/0190237 | A1* | 7/2012 | Zhu | H01R 13/6275 439/668 |
| 2012/0309221 | A1 | 12/2012 | Scherer et al. | |
| 2013/0052866 | A1 | 2/2013 | Il | |
| 2015/0093936 | A1* | 4/2015 | Little | H01R 13/6582 439/607.19 |
| 2016/0093984 | A1 | 3/2016 | Iwamoto | |
| 2018/0020145 | A1* | 1/2018 | Kotfis | H04N 5/2256 |
| 2018/0102611 | A1* | 4/2018 | Abouklassem | H01R 13/6583 |

FOREIGN PATENT DOCUMENTS

| | | | |
|---|---|---|---|
| JP | 2020107570 | A | 7/2020 |
| WO | 2005050792 | A2 | 6/2005 |
| WO | 2005055374 | A1 | 6/2005 |

* cited by examiner

ELECTRICAL DATA CONNECTOR

BACKGROUND OF THE INVENTION

This invention relates to electrical data connectors and, more particularly, to high speed data connectors that may be employed in automotive vehicles.

High speed data connectors, such as for example those that can handle data transmission rates of 1 Gb/second or more, are in wide use and may be employed in automotive data network architectures, which may include driver assist systems, vehicle display units, vehicle camera systems, consumer electronic ports, vehicle infotainment modules, and vehicle on-board diagnostics. Such high speed data connectors that are employed in automotive data networks must meet passenger car standards and regulations, while still being relatively inexpensive, reliable, and easy to fabricate and assemble.

SUMMARY OF THE INVENTION

According to a first aspect, this invention provides a high speed data connector that can, for example, handle data transmission rates of 1 Gb/second or more and that may be employed in an automotive data network, while meeting passenger car regulations and standards. Such a high speed data connector may be modular and scalable, compatible with unshielded and shielded twisted pair cables, relatively cost effective, reliable, and easy to fabricate and assemble.

According to another aspect, this invention provides grounding and shielding in the connector assembly, which provides an electrical connection of wire-shielding to a fixation-element to board locks.

According to yet another aspect, this invention provides an electrical data connector that includes a socket, a plug connector, and a cable head. The socket may have a socket body that defines a plug connector cavity and electrically conductive shields within the cavity. The plug connector may have a plug body that telescopically slides into and is releasably secured in the plug connector cavity, with the plug body having an insert cavity and adjacent spring openings, each of the spring openings aligning with a respective one of the shields. The cable head has an insert module that telescopically slides into and is releasably secured in the insert cavity, with the cable head including an electrically conductive fixation element that is fixed to the insert module and fixed to a cable, the fixation element including integral spring elements that extend generally radially outwardly from the insert module and each extend through respective spring openings into contact with respective shields when the cable head, the plug connector, and the socket are assembled together.

According to a further aspect, the invention provides for an electrical data connector that includes: a socket having a socket body that defines a plug connector cavity and electrically conductive shields within the cavity; a plug connector having a plug body configured to slide into the plug connector cavity, the plug body having an insert cavity and adjacent spring openings, each of the spring openings configured to align with a respective one of the shields when the plug connector is assembled to the socket; and a cable head having an insert module configured to slide into the insert cavity, the cable head including an electrically conductive fixation element that is fixed to the insert module, the fixation element including integral spring elements that are configured to flex radially inwardly, biased against the respective shields, when the cable head, the plug connector, and the socket are assembled together.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
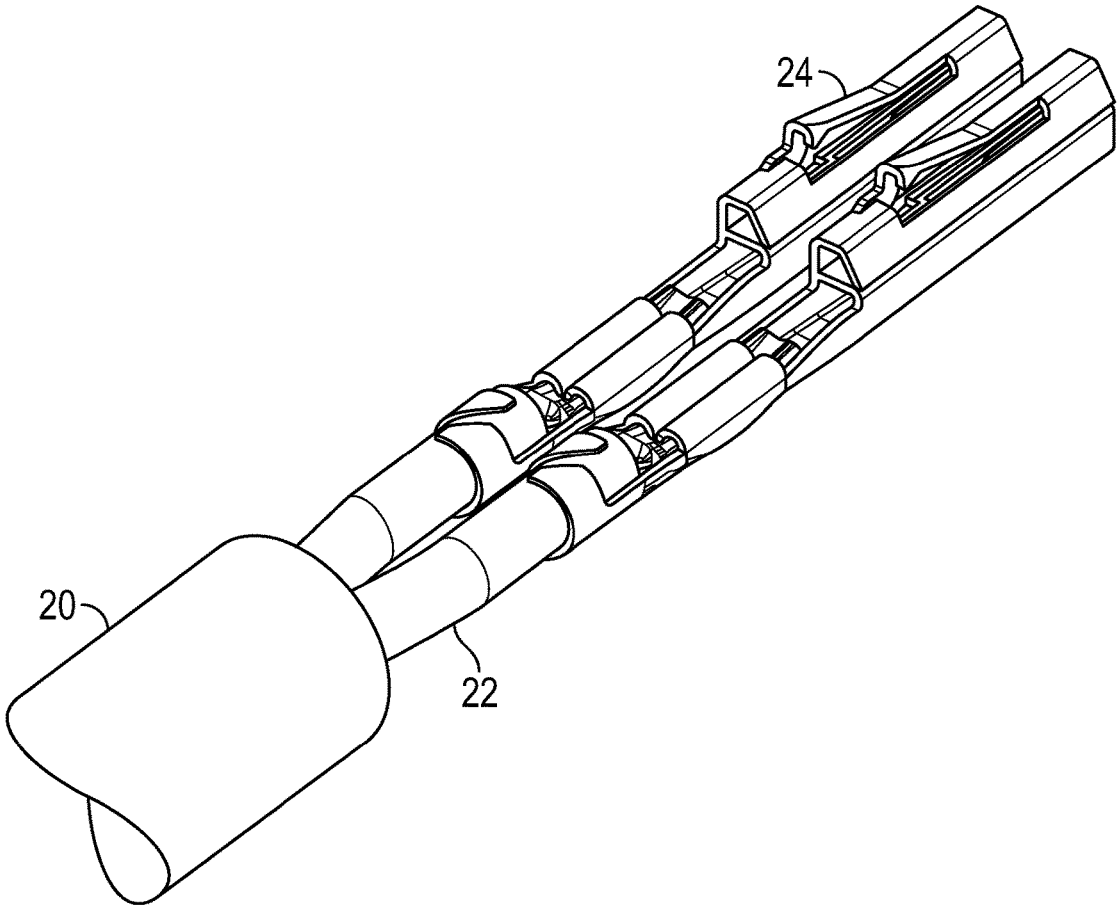
FIG. 1 is a schematic perspective view of a cable with terminals.

Referring now to the drawings, there is illustrated in FIG. 1 a cable 20 that may, for example, be a twisted pair, unshielded or shielded, cable including a pair of wires 22. The wires 22 may extend into and be secured to a respective pair of terminals 24. The terminals 24 may be employed, for example, to transmit high speed data (e.g., 1 Gb/s transmission rates or higher), which may be transmitted within a vehicle. However, the high speed data transmission structure disclosed herein is not limited to vehicle applications.

Figure 2:
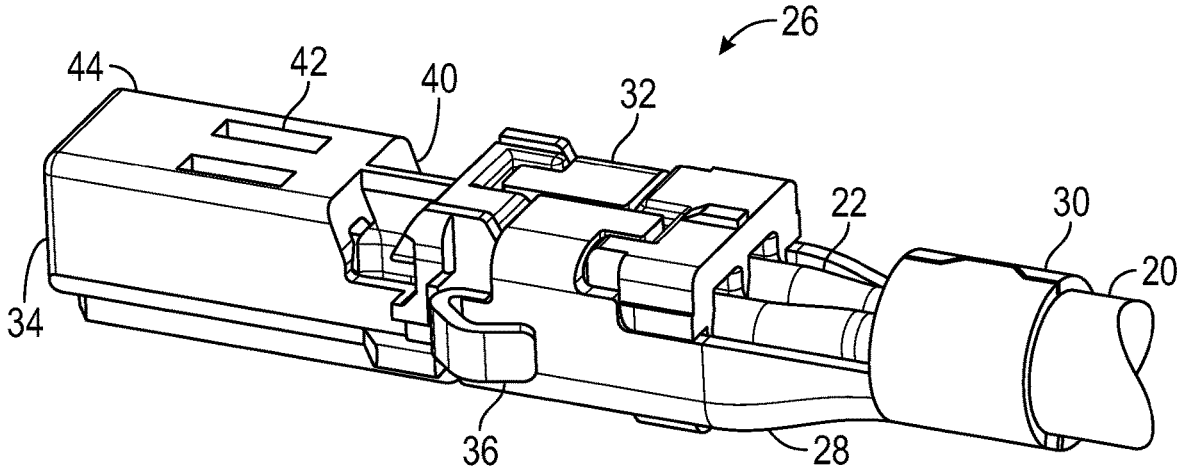
FIG. 2 is a schematic perspective view of a cable head.
Figure 3:
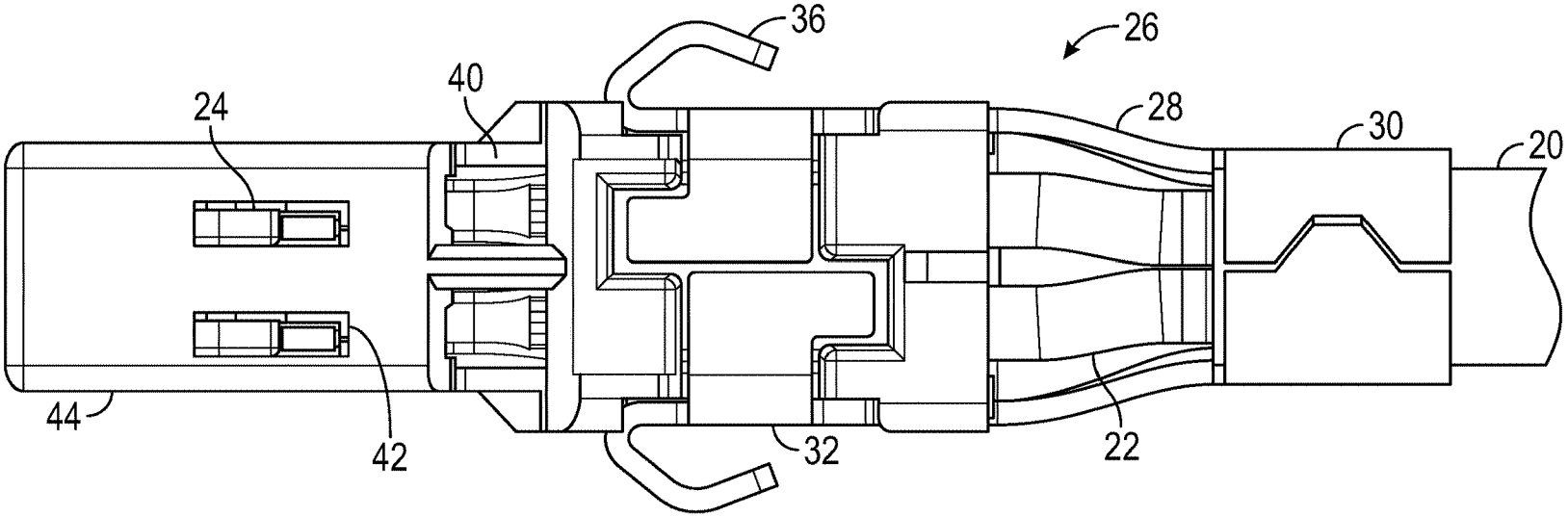
FIG. 3 is a schematic side view of the cable head.
Figure 4:
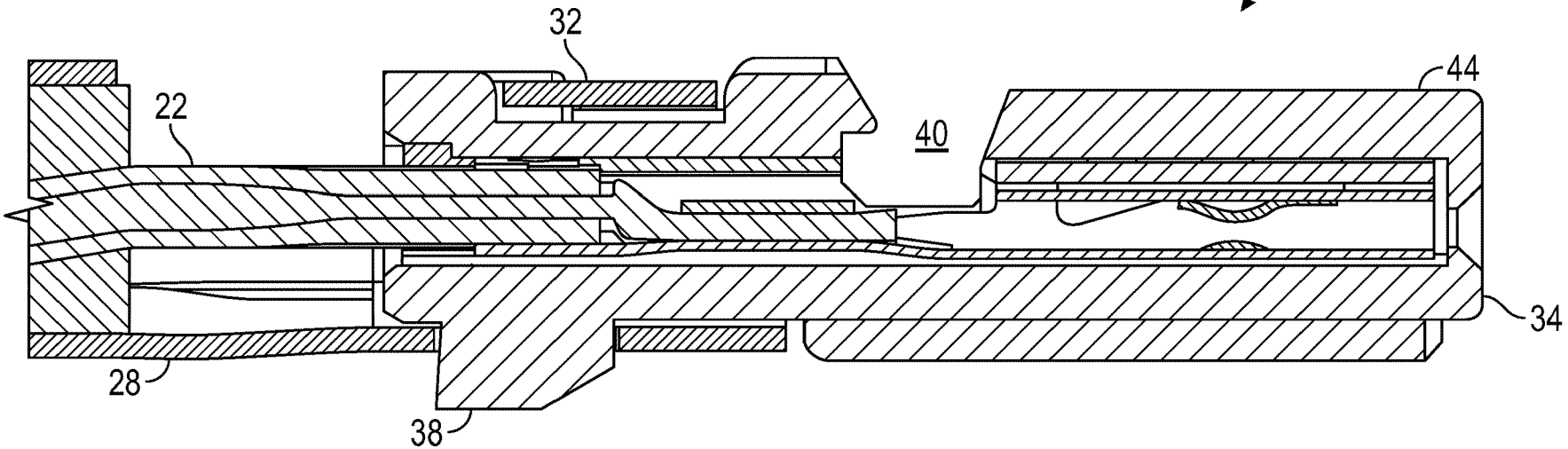
FIG. 4 is a schematic cross-sectional view of the cable head.

FIGS. 2 through 4 illustrate one of the cables 20 connected to a cable head 26. The cable head 26 includes a fixation element 28 that may be formed from a malleable material that can be plastically crimped to secure various components together. Preferably, the fixation element 28 may also be made of a material that allows for conduction of electricity therethrough. The fixation element 28 may include a cable clamp 30. During assembly, the fixation element 28 may be opened to allow the cable 20 to be inserted therein. Then, the cable clamp 30 may be plastically crimped or otherwise closed around outer insulation or outer shielding of the cable 20 to secure the cable 20 to the fixation element 28, as shown in the drawings. The fixation element 28 may include an insert clamp 32 that, during assembly, allows an insert module 34 to be inserted. Thereafter, the insert clamp 32 can be plastically crimped around the insert module 34 to secure the insert module 34 to the fixation element 28. Formed integrally with the fixation element 28 are a pair of spring elements 36. As used herein, the terms "integral" and "integrally" (including the claims) mean that the components are formed as a single monolithic piece, rather than separate pieces that are assembled together. Thus, the spring elements 36 are a single monolithic portion of the fixation element 28. As can be readily seen in FIGS. 2 and 3, the spring elements 36 are cantilevered, curving radially outwardly and backwardly (extending generally radially outwardly) and may extend from (i.e., be cantilevered from) a forward end of the fixation element 28. As also used herein (including the claims), the term "backward" indicates a direction toward the cable 20, and the term "forward" indicates a direction away from the cable 20 and toward the connector assemblies (as will be discussed in detail below).

The cable head 26 also includes the insert module 34, which may have a radially extending tab 38 to assist in securing the fixation element 28 to the insert module 34, and a secondary lock opening 40, which may be employed to assist in securing the cable head 26 to a plug connector (discussed below). The insert module 34 may also include a pair of terminal cavities 42 recessed within a main body 44, with each of the terminal cavities 42 receiving a respective one of the terminals 24. With this overall cable head 26, the insert module 34 is fixed relative to the cable 20 and wires 22.

Figure 5:
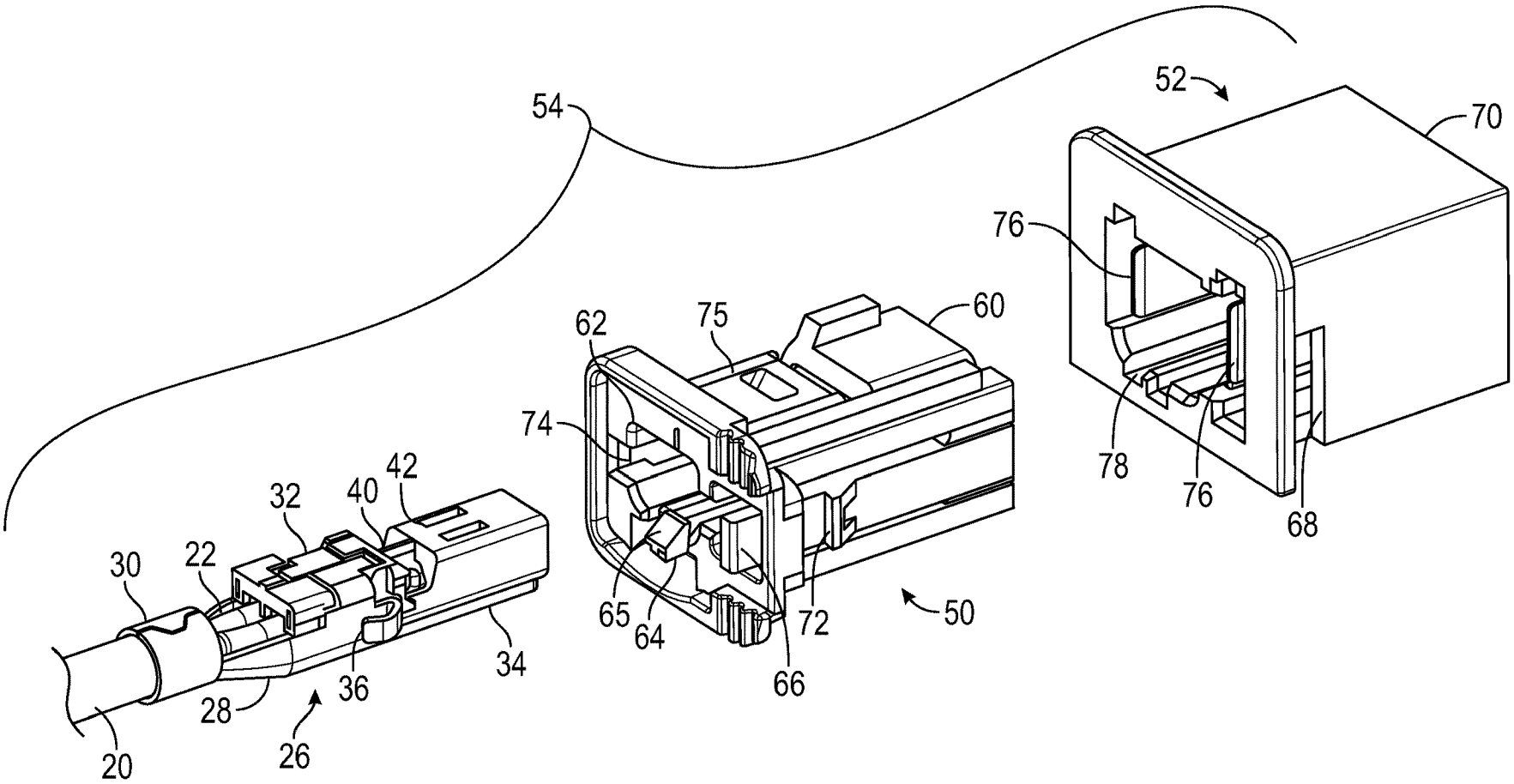
FIG. 5 is a schematic exploded perspective view of a high speed data connector.
Figure 6:
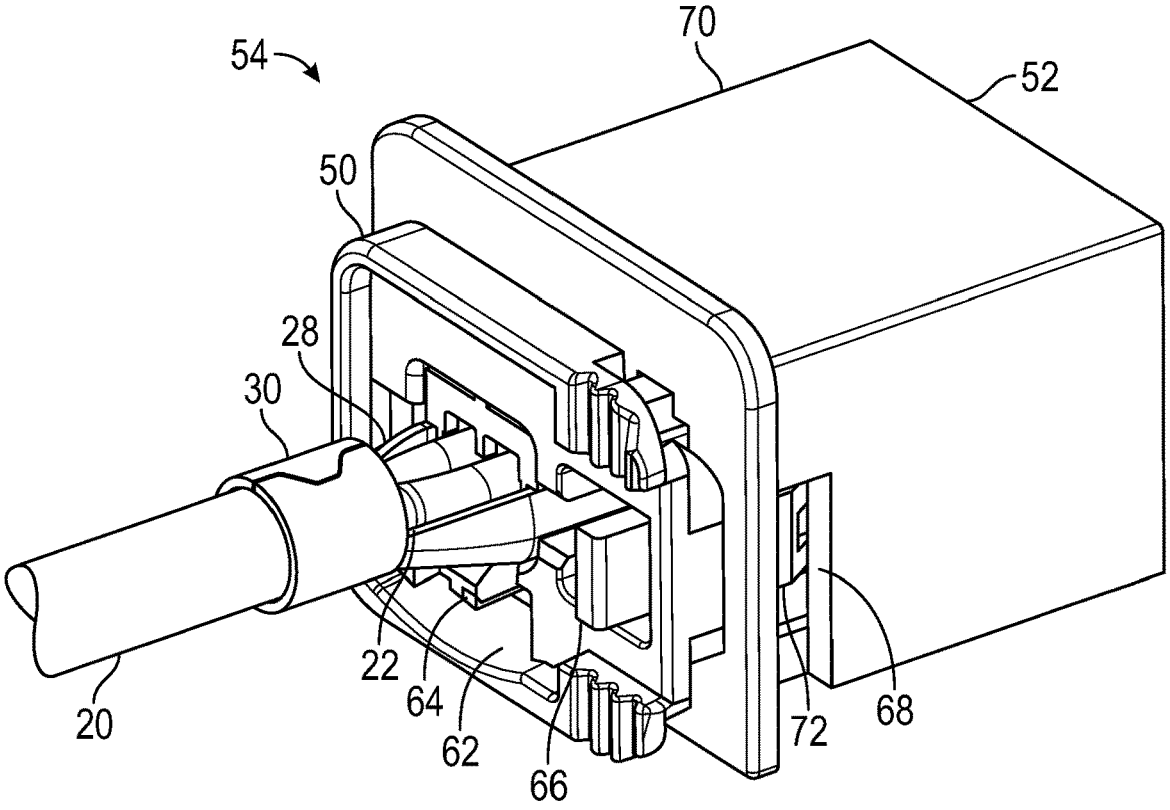
FIG. 6 is a schematic perspective view of the high speed data connector illustrated in FIG. 5 shown assembled.
Figure 7:
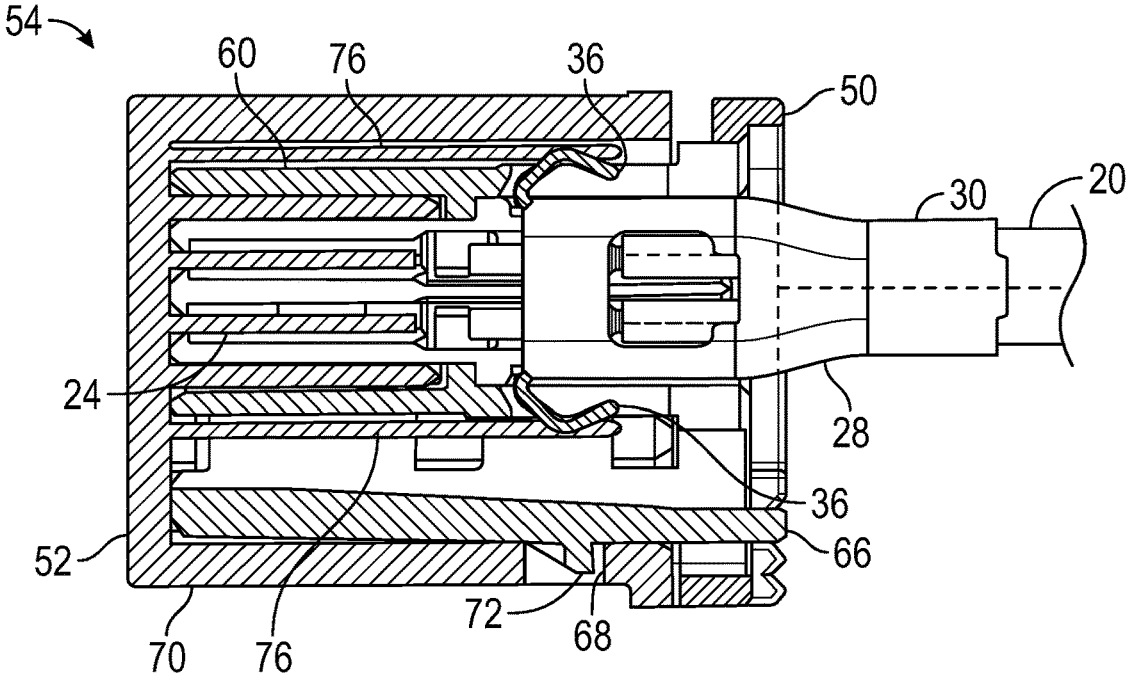
FIG. 7 is a schematic partial cross section view of the assembled high speed data connector taken along line 7-7 of FIG. 6 and rotated 180°.

FIGS. 5 through 7, with reference also to FIGS. 1 through 4, will now be discussed. Where elements have already been discussed in FIGS. 1 through 4, the same reference numbers will be used in FIGS. 5 through 7 without repeating the description thereof. The cable head 26 is part of an assembly, which also includes a plug connector 50 and a socket (also called a header) 52, that forms a high speed data connector 54. The high speed data connector 54 is shown in an exploded perspective view in FIG. 5, in an assembled perspective view in FIG. 6, and in a cross-sectional view in FIG. 7.

The plug connector 50 may include a body 60 defining an insert cavity 62. The insert cavity 62 is sized and shaped to telescopically receive the insert module 34 and releasably secure it therein. The body 60 may include an insert lock 64 that is cantilevered from a living hinge, from which it extends backward into releasable engagement with the cable head 26. For example, the insert lock 64 may include a barb 65 on its rearward end that releasably engages a recess in the cable head 26, thereby securing the cable head 26 to the plug connector 50 when the cable head 26 is telescopically inserted into the plug connector 50.

The body 60 of the plug connector 50 may also include a socket lock 66. The socket lock 66 may be cantilevered from a living hinge, from which it extends backwardly into releasable engagement with the socket 52. For example, the socket 52 may include a plug connector catch 68 recessed into a body 70 of the socket 52, which catch 68 releasably secures to a barb 72 on the socket lock 66 when the plug connector 50 is telescopically inserted into the socket 52. The body 60 may also include a secondary lock 75 that is also extends from a living hinge and is engageable with the secondary lock opening 40 of the insert module 34 when the cable head 26 is telescopically inserted into the plug connector 50.

The body 60 of the plug connector 50 may also include a pair of spring openings 74 that are respectively aligned with the spring elements 36 formed integrally with the fixation element 28, and also with respective shields 76 provided on the socket 52. The spring elements 36 and the shields 76 are located in a plug connector cavity 78 of the socket 52 when the high speed data connector 54 is fully assembled. The shields 76 may be formed from electrically conductive materials. The assembly of the high speed data connector 54 can be accomplished by initially inserting the cable head 26 telescopically into the plug connector 50, and then inserting the plug connector 50 telescopically into the socket 52. As this assembly takes place, the spring elements 36, which extend out radially farther than the respective radially inner surfaces of the shields 76, are caused to elastically flex inwardly. Thus, the spring elements 36 are biased into contact with their respective shields 76. After assembly, because the spring elements 36 are in contact with the respective shields 76 and are integral with the fixation element 28, grounding and complete shielding in the connector assembly is provided. Additionally, the fixation element 28, with which the spring elements 36 are integrally formed, may be secured to the outer shielding (if shielded) of the cable 20, providing a connection, via the fixation element 28, between the shielding of the cable 20 and the spring elements 36, which are in contact with the shields 76 of the socket 52.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical data connector comprising:

a socket having a socket body that defines a plug connector cavity and electrically conductive shields within the cavity;

a plug connector having a plug body configured to telescopically slide into and be releasably secured in the plug connector cavity, the plug body having an insert cavity and adjacent spring openings, each of the spring openings configured to align with a respective one of the shields when the plug connector is assembled to the socket; and a cable head having an insert module configured to telescopically slide into and be releasably secured in the insert cavity, the cable head including an electrically conductive fixation element that is fixed to the insert module and configured to be fixed to a cable, the fixation element including integral spring elements that extend generally radially outward from the insert module and are each configured to extend through the respective spring openings into contact with respective shields when the cable head, the plug connector, and the socket are assembled together.

2. The electrical data connector of claim 1, wherein the spring elements are curved, extending radially outward and backward.

3. The electrical data connector of claim 2, wherein the spring elements are configured to flex radially inward, biased against the respective shields when the cable head, the plug connector and the socket are assembled together.

4. The electrical data connector of claim 2, wherein the spring elements are cantilevered from a forward end of the fixation element.

5. The electrical data connector of claim 1, wherein the socket body includes a connector catch, and wherein the plug body includes a socket lock cantilevered from a living hinge and configured to releasably engage the connector catch when the plug connector is assembled to the socket.

6. The electrical data connector of claim 5, wherein the connector catch is a recess in the socket body, and wherein the socket lock includes a barb configured to extend into the connector catch when the plug connector is assembled to the socket.

7. The electrical data connector of claim 1, wherein the plug body includes an insert lock cantilevered from a living hinge and configured to releasably engage with the insert module when the cable head is assembled to the plug connector.

8. The electrical data connector of claim 1, wherein the fixation element includes an insert clamp that is configured to be plastically deformed around a portion of the insert module to secure the fixation element to the insert module.

9. The electrical data connector of claim 8, wherein the fixation element includes a cable clamp that is configured to be plastically deformed around the cable to secure the fixation element to the cable.

10. The electrical data connector of claim 8, wherein the spring elements are configured to flex radially inwardly, biased against respective shields, when the cable head, the plug connector and the socket are assembled together.

11. An electrical data connector comprising:

a socket having a socket body that defines a plug connector cavity and electrically conductive shields within the cavity;

a plug connector having a plug body configured to slide into the plug connector cavity, the plug body having an insert cavity and adjacent spring openings, each of the spring openings configured to align with a respective one of the shields when the plug connector is assembled to the socket; and a cable head having an insert module configured to slide into the insert cavity, the cable head including an electrically conductive fixation element that is fixed to the insert module, the fixation element including integral spring elements that are configured to flex radially inwardly, biased against the respective shields, when the cable head, the plug connector, and the socket are assembled together.

12. The electrical data connector of claim 11, wherein the spring elements are curved, extending radially outwardly and backward from the fixation element.

13. The electrical data connector of claim 12, wherein the spring elements are each configured to extend through the respective spring openings into contact with respective shields when the cable head, the plug connector, and the socket are assembled together.

14. The electrical data connector of claim 11 wherein the spring elements are cantilevered from a forward end of the fixation element.

15. The electrical data connector of claim 11, wherein the socket body includes a connector catch, and wherein the plug body includes a socket lock cantilevered from a living hinge and configured to releasably engage the connector catch when the plug connector is assembled to the socket.

16. The electrical data connector of claim 15, wherein the connector catch is a recess in the socket body, and wherein the socket lock includes a barb configured to extend into the connector catch when the plug connector is assembled to the socket.

17. The electrical data connector of claim 11, wherein the plug body includes an insert lock cantilevered from a living hinge and configured to releasably engage with the insert module when the cable head is assembled to the plug connector.

18. The electrical data connector of claim 11, wherein the fixation element includes an insert clamp that is configured to be plastically deformed around a portion of the insert module to secure the fixation element to the insert module.

* * * * *